United States Patent [19]

Klees

[11] 4,136,883

[45] Jan. 30, 1979

[54] GAME BOARD APPARATUS

[76] Inventor: Garry W. Klees, 9130 SE. 72nd Pl., Mercer Island, Wash. 98040

[21] Appl. No.: 857,213

[22] Filed: Dec. 5, 1977

[51] Int. Cl.[2] ..... A63F 3/00; G09B 1/20

[52] U.S. Cl. ..... 273/281; 35/27; 35/77

[58] Field of Search ..... 35/27, 77; 40/447, 493, 40/494, 501, 508, 509; 273/281, 291

[56] References Cited

U.S. PATENT DOCUMENTS

| | | | |
|---|---|---|---|
| 1,087,797 | 2/1914 | Lowe | 40/493 X |
| 2,628,838 | 2/1953 | Smalley | 273/281 |
| 3,410,011 | 11/1968 | Bowman | 35/77 X |
| 3,721,022 | 3/1973 | Mercorelli | 35/77 |
| 3,809,785 | 5/1974 | Calabrese | 35/77 X |

FOREIGN PATENT DOCUMENTS

| | | | |
|---|---|---|---|
| 21623 of | 1893 | United Kingdom | 35/77 |

*Primary Examiner*—Harland S. Skogquist

[57] ABSTRACT

A game board or display board wherein in the disclosed perferred game board embodiment an eight by eight array of individually rotatable blocks, each having a plurality of exterior surfaces of different colors, are supported on eight longitudinal shafts. Each block is separated from its next adjacent block by a spacer which surrounds two longitudinal shafts. Spring biasing is used to create an axial force acting longitudinally along each shaft to frictionally grip each block and retain it with its original surface showing, or another selected face which has been turned up by finger pressure by a player. Reset bars are provided to relieve the axial force, thereby allowing each block to rotate under the action of a weighted lobe and to return to its starting position to begin a new game.

8 Claims, 10 Drawing Figures

GAME BOARD APPARATUS

BACKGROUND OF THE INVENTION

1. Field of the Invention

This invention relates to apparatus for game-playing; and more particularly, to an array of rotatable blocks held within a frame wherein the blocks may each be individually rotated to show a selected one of a plurality of faces, and wherein all of the blocks may be automatically rotated to a predetermined reset position of actuation of a reset mechanism.

2. Discussion of the Prior Art

According to "The Illustrated Book of Table Games" by Peter Arnold, the game known as "Reversi" originated in England during the 19th century. Game boards and pieces are now being sold in this country under another name, and the game is enjoying a resurgence of popularity. The game is played on a board similar to a checker board with flat chips having different colors on opposite faces. The chips must be accurately positioned by the player within marked squares on the board, with the player's color face-up. During the course of a game, the pieces are turned over by the players, and changed in color, many times. The time involved in picking up the chips, turning them over and replacing them delays the game. This is an annoying task which detracts from enjoyment of the game, particularly since many moves require turning over ten to fifteen pieces.

The game is simple to learn but is complex and challenging. There are only 32 moves per player and therefore it takes less than 30 minutes to play. However, loose pieces floating around the board, the attention required to place them in the squares, and the task of turning them over several hundred times are basic problems which have limited the popularity of the game. Another problem is that all the pieces must be picked up at the end of the game, in order to restart another game with a clean board.

It is a general object of this invention to create an apparatus for rapidly and conveniently playing games of a type where loose chips are arranged and moved on a board, such as the game Reversi.

It is a related object of this invention to create an array of rotatable blocks, each with a plurality of faces bearing selected colors or symbols, for use as a game or display apparatus wherein the blocks may be individually rotated to display a selected face and retained there until rotated again, and wherein all of the blocks may be automatically rotated to a predetermined starting position upon actuation of a reset mechanism.

Various devices have been proposed in the past for creating a rectangular array of blocks which may be individually rotated to show a selected face. See for example, The U.S. Patents to Wasserman (U.S. Pat. No. 2,452,341) and to Glass et al. (U.S. Pat. No. 3,462,857). Somewhat related game or display board devices include those shown in the following U.S. Pat. Nos.: Bella (2,684,247), Ardis (3,178,185), Breslow et al. (3,481,606), Kunlik et al. (3,708,171), Lintorri (3,836,152), Foerst (3,891,219), and Senesac (2,323,157).

While each of the above listed devices is useable in one manner or another, they each suffer from one or more of the following deficiencies: (1) are complex and expensive to construct; (2) do not have means to retain the block in the desired position after selected rotating; or (3) do not have manually actuated reset means for automatically returning all blocks to a desired starting position.

SUMMARY OF THE INVENTION

The above and other objects of the invention are achieved in the disclosed preferred embodiment wherein a plurality of longitudinal shafts extend from a first to an opposite end of a rectangular frame, and rotatable multi-lobed blocks, each having a weighted lobe, are rotatably mounted on said shafts. Each block is separated from its next adjacent block by spacer means surrounding at least two of said longitudinal shafts, and biasing means are provided to create an axial force acting longitudinally along each of said shafts to cause frictional engagement between each of said blocks and its next adjacent spacer means. Manually actuated reset means are provided to relieve said axial force and to allow each block to instantly return to its predetermined starting position under influence of its weighted lobe.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
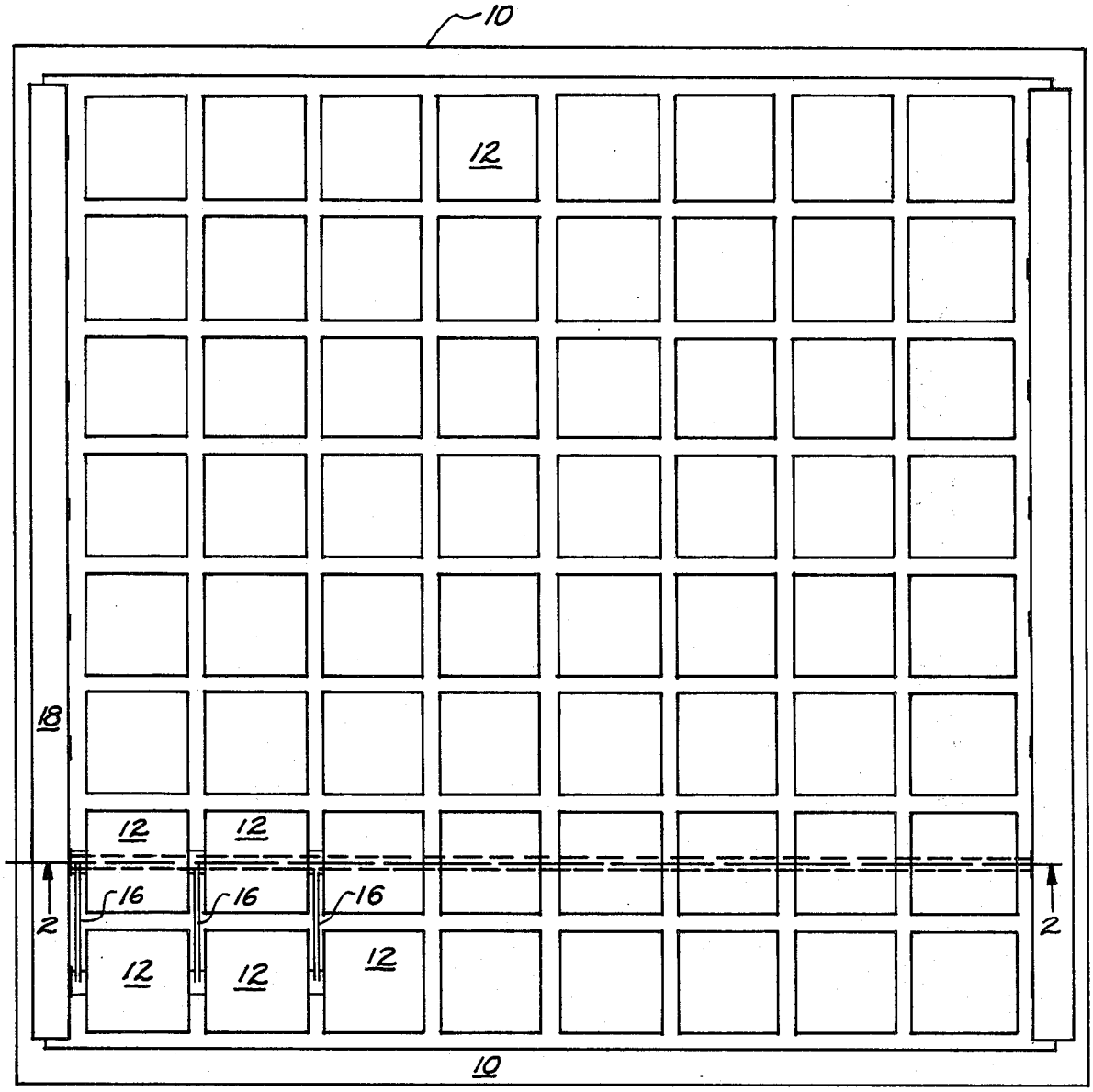
FIG. 1 is a plan view of a preferred embodiment of the game board of this invention.

FIG. 1 shows in plan view a game board frame 10 constructed according to this invention, and having sixty-four individual rotatable blocks 12 arranged in a square array in the manner of a chess, checker or reversi game board.

Figure 2:
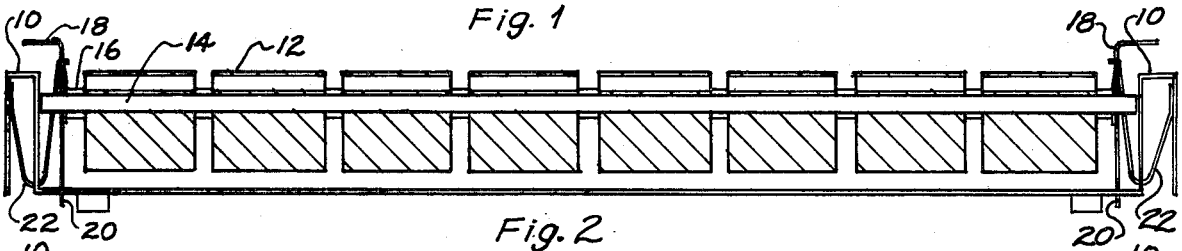
FIG. 2 is a sectional view taken at 2—2 in FIG. 1.

As is best seen in FIG. 2, a cross-section view taken at 2—2 in FIG. 1, a longitudinal shaft 14 extends from a first side to an opposite side of frame 10. On the game board shown, eight such independent shafts 14 are in parallel alignment, each carrying eight rotatable blocks 12. Each block 12 is separated from its next adjacent block by spacer bars 16. Each spacer bar 16 extends between and surrounds two next adjacent shafts 14, for reasons that will be explained later. The board is provided with oppositely disposed reset means 18 extending substantially along opposite sides of frame 10. Each reset means 18 is provided with three tabs 20 which extend through openings in the base of frame 10. The tabs 20 permit reset means 18 to pivot with respect to frame 10. A biasing spring means 22 urges each of the reset means 18 into contact the outside spacer bars 16, and thereby creates along shafts 14 an axial load which grips by frictional engagement, each spacer bar 16 and each block 12. It will be apparent then, that a person using the game board may rotate any one selected block to show a different face without disturbing the other blocks. This is done with just enough finger presser to overcome the friction forces acting between the selected block and its two adjacent spacer means 16. Once the selected block is rotated to show the face desired, the frictional forces will retain it in that position. The spacer bars 16 cannot rotate because they are attached to at least two of the shafts 14, and hence they cannot pass a rotational force to the blocks on either side of the selected block.

Figure 3:
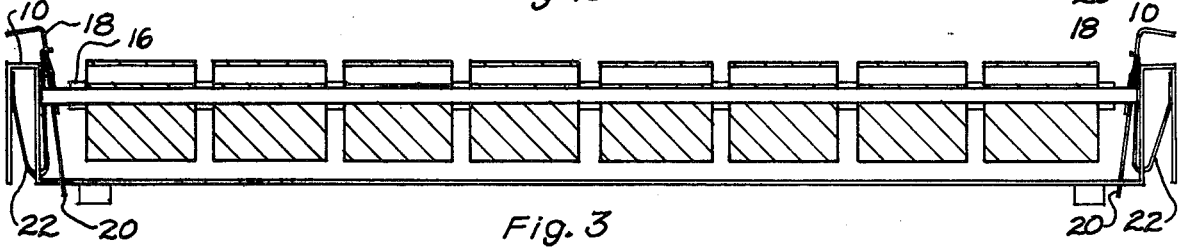
FIG. 3 is a sectional view similar to FIG. 2, but showing the biasing means in its reset position.

FIG. 3 shows the position of the reset means 18 and biasing means 22 when an outwardly acting force is applied to each reset means 18, as by thumb pressure applied by a user. It can be seen that there is no longer any contact between reset means 18 and the outer spacer means 16. Therefore, the axial load acting along the shaft 14 which tended to frictionally hold each block and prevent it from rotating has been relieved. Each block 12 is provided with a weighted lobe and is now free to rotate to the desired reset position under the infuence of gravity acting on the weighted lobe.

Figure 4:
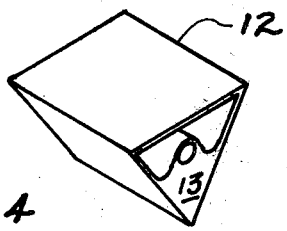
FIG. 4 is an isolated perspective view of a rotatable block used in FIG. 1.

FIG. 4 is an isolated isometric view of a single block 12, which is preferably constructed of plastic with three exterior surfaces, each carrying a different color or symbol, and a solid or weighted lobe 13 opposite the starting, or reset, one of the surfaces.

Figure 5:
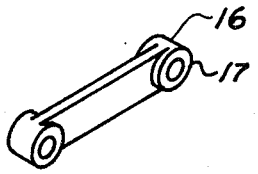
FIG. 5 is an isolated perspective view of a spacer bar used in FIG. 1.

FIG. 5 is an isometric view of one of the space bars 16 of FIGS. 1, 2 and 3. Spacer bar 16 is provided with a pair of enlarged bosses 17 surrounding each of the openings for the shafts 14 at its opposite ends. When the mechanism is assembled the bosses 17 will contact and grip the end faces of blocks 12 under the axial force prodied by biasing means 22. The bosses thus provide a predetermined contact area for frictional engagement between the spacer bars 16 and the blocks 12. The size of the predetermined contact area should be optimized in view of the smoothness and other frictional characteristics of the materials used and the amount of spring force imparted by biasing means 22, in order to allow the individual blocks to be readily rotated by finer pressure, but to be securely retained in position despite inadvertent minor movement of the entire game board.

Figure 7:
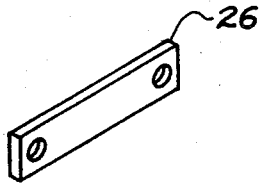
FIG. 7 is a view similar to that of FIG. 5 showing an optional spacer bar for use with the block of FIG. 6.
Figure 6:
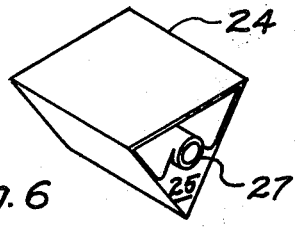
FIG. 6 is a view similar to that of FIG. 5 showing an optional rotatable block.

FIGS. 6 and 7 show an optional construction for the blocks and spacers of FIGS. 1–5. In FIG. 6 a block 24 is provided with an enlarged boss 27, surrounding the opening for shaft 14 at the upper end of weighted lobe 25. The spacer bar 26 of FIG. 7 is flat, since the boss, and the predetermined contact area is provided on block 24.

Figure 8:
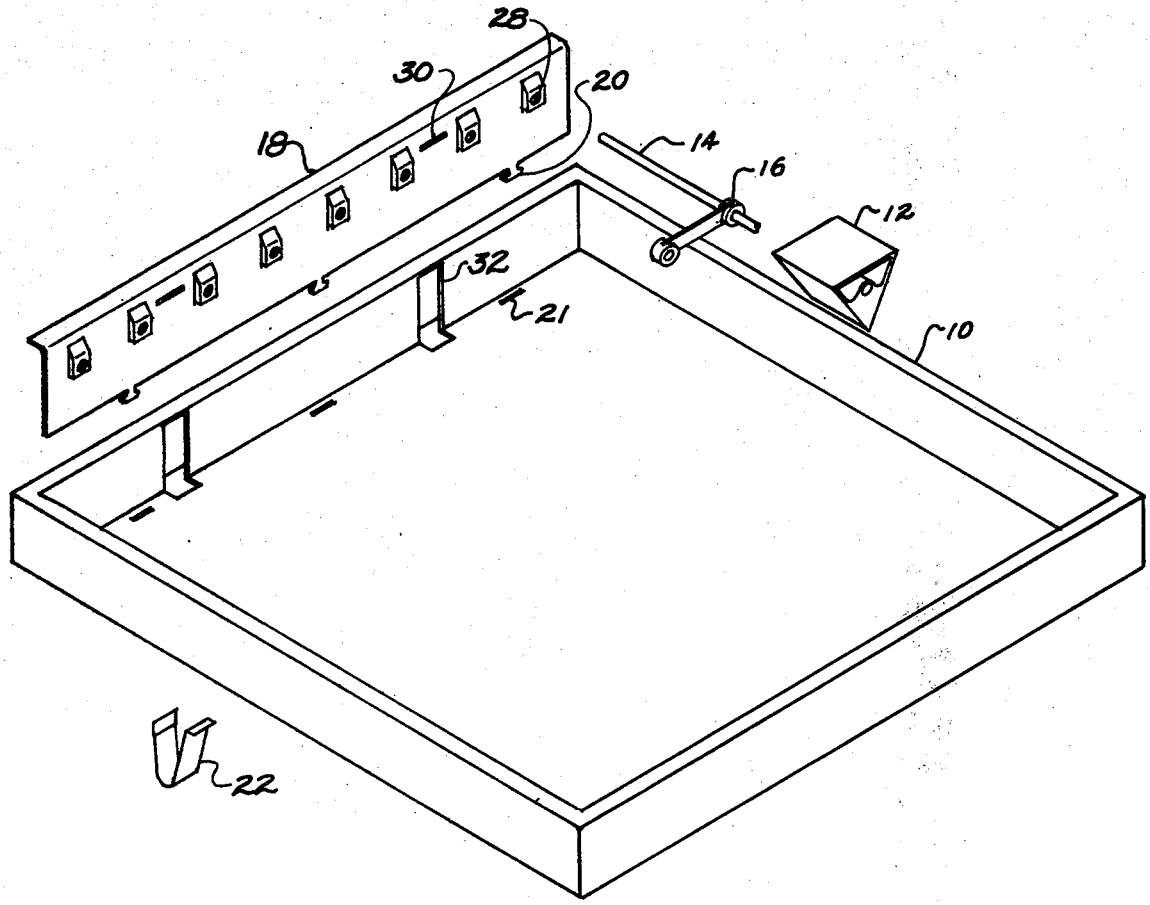
FIG. 8 is an exploded perspective view of the game board of FIG. 1 showing the relationships of the board frame, the longitudinal shafts, the biasing means, the rotatable blocks, the spacer bars, and the reset means.

FIG. 8 is an exploded perspective view of the game board of FIGS. 1–5 showing details of construction. Reset means 18 is an angle shaped bar with three tabs 20 which are inserted in slots 21 in the base of frame 10. The biasing spring means 22 comprises a pair of spring clips, the outer tab of which is inserted into slots 30 in the reset means 18. A recess 32 is provided in the wall of frame 10 to nest and secure the biasing spring means 22. The reset means 18 is provided wth spring tabs 28 having circular holes through which the shafts 14 are passed upon assembly of the mechanism. The spring tabs 28 will contact the bosses of the outer spacer bars 16 and, during normal operation, will pass the axial load to the spacer bars for frictional gripping of the rotatable blocks 12. It will be apparent then that the primary spring biasing is accomplished by the clips of means 22, but secondary biasing, and compensation for tolerances etc., is provided by spring tabs 28.

Figure 9:
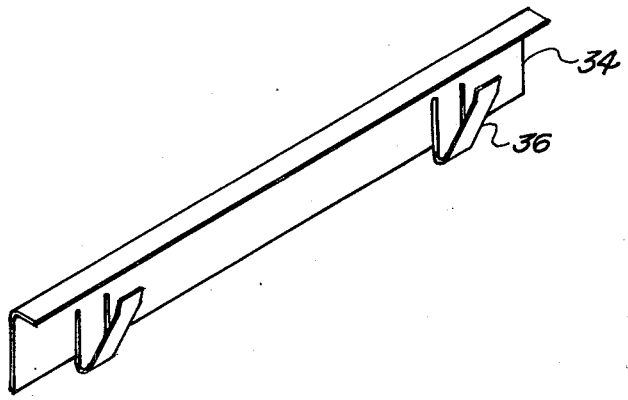
FIG. 9 is a perspective view of an alternate integral construction of the biasing means and the reset means.
Figure 10:
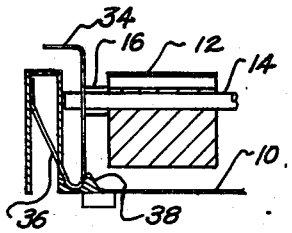
FIG. 10 is a cross-section view of the frame with biasing and reset means according to FIG. 9.

FIGS. 9 and 10 illustrate an alternate construction for the biasing means and reset means of the previous figures. A reset means 34 and biasing means 36 are formed from a single sheet of material. Frame 10 is provided with surfaces 38 that nest the lower ends of biasing means 36, both in the normal position shown in FIG. 10, and in the reset position (not shown).

It should be apparent from the foregoing description and drawings, that the disclosed invention provides apparatus for rapidly and conveniently playing games of a type where, at present, loose chips must be arranged and moved on a board. It will also be apparent to persons skilled in the mechanical arts that many modifications and variations may be made to the preferred embodiments which have been specifically disclosed without departing from the spirit and scope of the invention For example, other alternate embodiments considered to date include one wherein the biasing means act on a network of individual cantilever elements in contact with multifaced cams attached to the blocks. Accordingly, it is intended in the appended claims to cover all such modifications and variations.

What is claimed and desired to be secured by U.S. Letters Patent is:

1. A game and display board mechanism comprising: an enclosed frame; a plurality of shafts aligned parallel to each other and extending from a first to an opposite side of said frame; a plurality of blocks mounted for rotational movement on each of said shafts; said blocks each having a plurality of exterior surfaces and a weighted lobe located within each block to cause the display of a selected one of said exterior surfaces when said blocks are allowed to rotate freely on said shafts; biasing spring means for providing a predetermined force acting on each of said blocks to prevent inadvertent rotational movement; and manually actuated reset means for relieving said predetermined force to allow each of said blocks that are not displaying said selected one of said exterior faces to rotate under the action of its weighted lobe to display said selected one of said exterior surfaces.

2. The mechanism of claim 1 wherein each of said blocks is generally triangular in shape and has three exterior surfaces, and said weighted lobe is located opposite said selected one of said exterior surfaces.

3. The mechanism of claim 1 which additionally comprises spacer means located between adjacent blocks and extending between and surrounding at least two of said shafts.

4. The mechanism of claim 1 wherein said biasing spring means for providing a predetermined force acting on each of said blocks to prevent inadvertent rotational movement comprises means for creating an axial load along each of said shafts to grip said blocks in frictional engagement to prevent inadvertent rotational movement.

5. A game and display board mechanism comprising: an enclosed frame; a plurality of shaft aligned parallel to each other and extending from a first to an opposite side of said frame; a plurality of blocks mounted for rotational movement on each of said shafts; said blocks each having a plurality of exterior surfaces and weighted lobe located within each block to cause the display of a selected one of said exterior surfaces when said blocks are allowed to rotate freely on said shafts; spacer means located between adjacent blocks and extending between and surrounding at least two of said shafts; a biasing spring means for creating an axial load along each of said shafts to grip said spacer means and said blocks in frictional engagement to prevent inadvertent rotational movement of said blocks; and reset means for relieving said axial load to allow each of said blocks to rotate under action of its weighted lobe to display said selected one of said exterior surfaces.

6. The mechanism of claim 5 wherein each of said blocks is generally triangular in shape and has three exterior surfaces, and said weighted lobe is located opposite said selected one of said exterior surfaces.

7. The mechanism of claim 5 wherein each of said blocks comprises two outwardly extending oppositely disposed bosses surrounding the shaft in which the block is mounted; each of said bosses being in frictional contact with said spacer means under the influence of said axial load.

8. The mechanism of claim 5 wherein each of said spacer means comprises two bosses, each surrounding a different one of said shafts and each being in frictional contact with at least one of said blocks under the influence of said axial load.

* * * * *